United States Patent [19]

Puig Planas

[11] 4,177,904

[45] Dec. 11, 1979

[54] SEAL ASSEMBLY FOR BOTTLES OR FLASKS

[76] Inventor: Antonio Puig Planas, No. 7 Juan Sebastian Bach St., Barcelona, Spain

[21] Appl. No.: 927,041

[22] Filed: Jul. 24, 1978

[30] Foreign Application Priority Data

Oct. 10, 1977 [ES] Spain ..... 231.303

[51] Int. Cl.[2] ..... B65D 41/08

[52] U.S. Cl. ..... 215/12 R; 215/274; 215/335

[58] Field of Search ..... 215/12 R, 31, 274, 335; 220/315

[56] References Cited

U.S. PATENT DOCUMENTS

| | | | |
|---|---|---|---|
| 1,996,674 | 4/1935 | Cross | 215/12 R |
| 3,746,199 | 7/1973 | Hart | 215/335 X |
| 3,899,096 | 8/1975 | Marco | 215/335 X |

FOREIGN PATENT DOCUMENTS

| | | | |
|---|---|---|---|
| 438063 | 11/1967 | Switzerland | 215/31 |

*Primary Examiner*—Donald F. Norton
*Attorney, Agent, or Firm*—Wenderoth, Lind & Ponack

[57] ABSTRACT

A seal assembly for bottles or flasks includes a neck member having a generally elongated hollow configuration adapted to non-rotatably fit about the exterior of a bottle or flask. A generally hollow cylindrical intermediate member has a portion which fits within the neck member and cooperates therewith to prevent relative rotation therebetween. The intermediate member has on the interior thereof a device to cooperate with the neck of the bottle or flask to prevent relative longitudinal movement therebetween. The intermediate member has at the upper end thereof a dispensing opening adapted to align and cooperate with the opening in the neck of the bottle or flask. A stopper member has a closed upper end and an open lower end and threads onto the exterior of the intermediate member such that the closed upper end of the stopper member blocks the dispensing opening of the intermediate member.

9 Claims, 2 Drawing Figures

SEAL ASSEMBLY FOR BOTTLES OR FLASKS

BACKGROUND OF THE INVENTION

The present invention relates to a seal assembly which may be used to seal off the opening in the neck of a bottle or flask and to selectively allow dispensing of product from the bottle or flask.

SUMMARY OF THE INVENTION

More particularly, the present invention relates to such a seal assembly including three separate but connectable components, i.e a neck member adapted to be non-rotatably positioned about the top portion of the exterior walls of a bottle or flask, an intermediate member adapted to fit around the neck of the bottle or flask and to be connected with the neck member to prevent relative rotation therebetween, and a stopper portion which may be selectively removably threaded onto the exterior of the intermediate member. The top portion of the intermediate member includes a dispensing opening which aligns with the opening in the neck of the bottle or flask. When the stopper member is screwed onto the intermediate member, the dispensing opening is blocked and sealed, thereby preventing dispensing or leakage of the product from the interior of the bottle or flask. When the stopper member is selectively removed from the intermediate member, then product may be dispensed from the interior of the bottle or flask through the dispensing opening of the intermediate member. An internal annular projection of the intermediate member abuts against a surface of a recess in the exterior of the neck of the bottle or flask, thereby preventing longitudinal relative movement between the intermediate member and bottle or flask. The bottom end of the intermediate member has therein at least one notch which is dimensioned to receive a correspondingly configured projection on an interior wall of the neck member, thereby preventing relative rotation between the intermediate member and the neck member. Alternatively, if the relative members are sufficiently elastic, the recess may be in the neck member, and the projection may be on the intermediate member.

BRIEF DESCRIPTION OF THE DRAWINGS

Other objects, features and advantages of the present invention will become apparent from the following detailed description of a preferred embodiment thereof, taken with the accompanying drawings, wherein.

DETAILED DESCRIPTION OF THE INVENTION

The seal for bottles or flasks of the present invention includes three separate but interconnectable components, i.e. stopper member 1, intermediate member 2, and neck member 3. All three components can be made of suitable and desirable materials. However, the components are preferably made of a plastic material, thereby ensuring a tight seal. It is particularly preferable that intermediate member 2 be formed of a plastic material, thereby ensuring a tight seal of the entire assembly.

Stopper member 1 includes a generally cylindrical portion (although the exterior configuration thereof is not of great importance) having an open lower end and a closed top end. The interior of the cylindrical portion has therein female threads.

Figure 1:
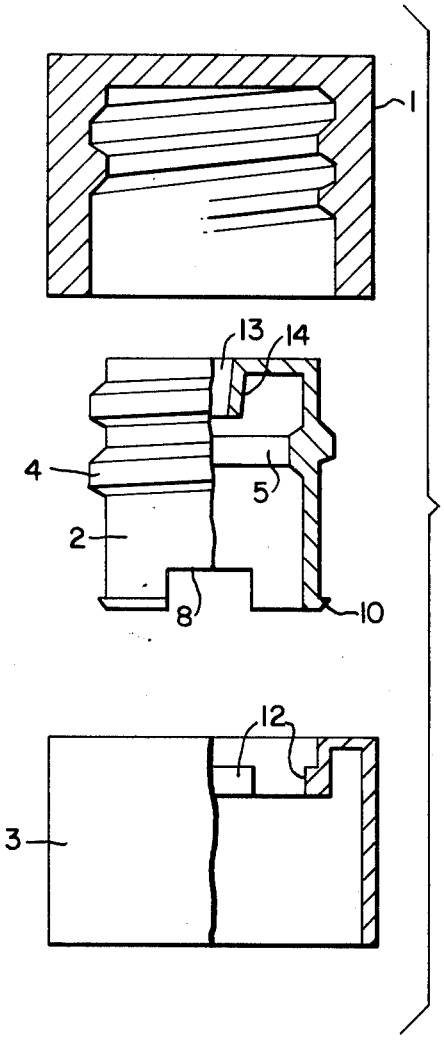
FIG. 1 is an exploded view, partially in cross-section, of the various components of the seal of the present invention.
Figure 2:
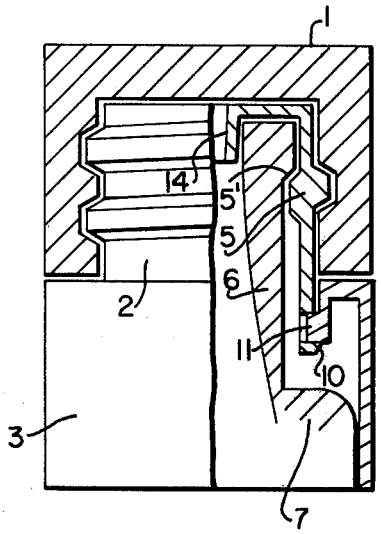
FIG. 2 is an elevation view, partially in cross-section, illustrating the seal components of FIG. 1 assembled to each other and assembled to a bottle or flask.

Intermediate member 2 is of generally hollow cylindrical configuration having an open lower end. The upper end is substantially closed by an integral disc member. However, the central portion of the disc member has a downwardly depending flange 14 with an opening 13 therethrough. The exterior surface of intermediate member 2 has male threads 4 dimensioned to mate with the female threads in the interior of stopper member 1. The interior of intermediate member 2 has therein an inwardly extending annular projection 5 adapted to abut with the surface of an inwardly extending annular recess 5' on the neck 6 of a flask or bottle 7, as shown in FIG. 2.

The lower edge of intermediate member 2 has an outwardly extending annular ring 10. Also, the lower edge of intermediate member 2 has formed therein at least one notch 8, and preferably plural notches 8. The notch or notches 8 can be of any desired configuration, such as the generally rectangular configuration illustrated.

Neck member 3 may desirably be formed of a plastic material and has a generally elongated hollow configuration, the internal dimensions of which are adapted to fit against the external walls of the bottle or flask 7. For example, if the exterior walls of flask 7 are irregularly configurated, then the interior configuration of neck member 3 would be correspondingly formed, whereby when neck member 3 is positioned on flask 7 as shown in FIG. 2, the neck member 3 cannot be rotated with respect to flask 7. In the event that the exterior configuration of flask 7 is circular, then relative rotation between flask 7 and neck member 3 may be prevented by a frictional contact therebetween.

Neck member 3 has at the upper end thereof an integral radially inwardly and longitudinally downwardly extending flange or wall 11 which forms a circular opening adapted generally to fit around the exterior of intermediate member 2. Furthermore, the interior surface of wall 11 has therein a radially inwardly extending projection 12 (or projections 12) which is dimensioned to fit within the notch or notches 8 provided in the lower end of intermediate member 2, as shown in FIG. 2.

Thus, when the seal assembly is assembled onto flask 7, as shown in FIG. 2, the neck member 3 is fitted around the exterior wall or walls of flask 7, thereby preventing turning of neck member 3 with respect to the flask 7. The intermediate member 2 is positioned over the neck 6 of flask 7 and within the inner wall 11 of neck member 3 such that projections 12 of neck member 3 fit within respective notches 8 in intermediate member 2, such that the bottom edge of inner wall 11 rests on annular ring 10, and such that the upper portion of projection 5 of intermediate member 2 abuts against the lower edge forming recess 5' in neck 6 of flask 7. By the respective interengagement of projections 12 and notches 8, neck member 3 prevents relative rotation of intermediate member 2.

The stopper member 1 is then screwed onto the intermediate member 2 by means of the meshing threads thereof. In this closed position, illustrated in FIG. 2, stopper member 1 closes the flask 7. A tight seal is provided by the engaging threads of stopper member 1 and intermediate member 2, by the abutment of projections 5 against the edge forming recess 5' of the neck 6 of the flask 7, and additionally by the stopper member 1 pressing the top of intermediate member 2 against the top edge of neck 6 of flask 7.

When it is desired to dispense material from flask 7, stopper member 1 may be unscrewed from and thereby removed from intermediate member 2. Thus, it is possible to dispense the contents of flask 7 through the opening 13 in flange 14 of intermediate member 2. The interengagement of inner projection 5 of intermediate member 2 and the edge forming recess 5' in neck 6 of flask 7 prevents longitudinal sliding of the intermediate member 2 with respect to the axis of the flask.

Although a specific embodiment of the seal assembly of the present invention has been described above, it is to be understood that various modifications may be made to the specific structural features described and illustrated without departing from the scope of the present invention.

What I claim is:

1. A seal assembly for bottles or flasks, said seal assembly comprising:

a neck member having a generally elongated hollow configuration adapted to non-rotatably fit about the exterior of a bottle or flask, said neck member having an upper end and an integral radially inwardly and longitudinally downwardly extending wall, said wall having at least one inwardly extending projection;

a generally hollow cylindrical intermediate member including means cooperating with said neck member to prevent relative rotation therebetween, said intermediate member having on the interior thereof means cooperable with a neck of the bottle or flask to prevent relative longitudinal movement therebetween, said intermediate member having an upper end having therein a dispensing opening adapted to align and cooperate with an opening in the neck of the bottle or flask to dispense product therefrom; and a stopper member having a closed upper end and an open lower end, said stopper member having means cooperating with said intermediate member for removably attaching said stopper member to said intermediate member such that said closed upper end of said stopper member blocks said dispensing opening of said intermediate member.

2. A seal assembly as claimed in claim 1, wherein an interior surface of said stopper member and an exterior surface of said intermediate member have interengaging screw threads for attachment of said stopper member to said intermediate member.

3. A seal assembly as claimed in claim 1, wherein said intermediate member has on the interior thereof an inwardly extending annular projection adapted to abut against a surface defining an annular recess in the neck of the bottle or flask.

4. A seal assembly as claimed in claim 1, wherein said upper end of said intermediate member has extending substantially thereacross an integral disc adapted to contact the upper edge of the neck of the bottle or flask, said disc having therein a downwardly depending flange defining said dispensing opening.

5. A seal assembly as claimed in claim 1, wherein said intermediate member has a lower end having at least one recess therein, said projection fitting into said recess thereby preventing relative rotation between said intermediate member and said neck member.

6. A seal assembly as claimed in claim 5, wherein said lower end of said intermediate member has extending radially outwardly therefrom an annular ring, the lower edge of said wall of said neck member resting on said annular ring.

7. A seal assembly for bottles or flasks, said seal assembly comprising:

a neck member having a generally elongated hollow configuration adapted to non-rotatably fit about the exterior of a bottle or flask;

a generally hollow cylindrical intermediate member including means cooperating with said neck member to prevent relative rotation therebetween, said intermediate member having on the interior thereof means cooperable with a neck of the bottle or flask to prevent relative longitudinal movement therebetween, said intermediate member having an upper end having therein a dispensing opening adapted to align and cooperate with an opening in the neck of the bottle or flask to dispense product therefrom;

a stopper member having a closed upper end and an open lower end, said stopper member having means cooperating with said intermediate member for removably attaching said stopper member to said intermediate member such that said closed upper end of said stopper member blocks said dispensing opening of said intermediate member; and an interior surface of said stopper member and an exterior surface of said intermediate member having interengaging screw threads for attachment of said stopper member to said intermediate member.

8. A seal assembly for bottles or flasks, said seal assembly comprising:

a neck member having a generally elongated hollow configuration adapted to non-rotatably fit about the exterior of a bottle or flask;

a generally hollow cylindrical intermediate member including means cooperating with said neck member to prevent relative rotation therebetween, said intermediate member having on the interior thereof an inwardly extending annular projection adapted to abut against a surface defining an annular recess in the neck of the bottle or flask to prevent relative longitudinal movement therebetween, said intermediate member having an upper end having therein a dispensing opening adapted to align and cooperate with an opening in the neck of the bottle or flask to dispense product therefrom; and a stopper member having a closed upper end and an open lower end, said stopper member having means cooperating with said intermediate member for removably attaching said stopper member to said intermediate member such that said closed upper end of said stopper member blocks said dispensing opening of said intermediate member.

9. A seal assembly for bottles or flasks, said seal assembly comprising:

a neck member having a generally elongated hollow configuration adapted to non-rotatably fit about the exterior of a bottle of flask;

a generally hollow cylindrical intermediate member including means cooperating with said neck member to prevent relative rotation therebetween, said intermediate member having on the interior thereof means cooperable with a neck of the bottle or flask to prevent relative longitudinal movement therebetween, said intermediate member having an upper end having extending substantially thereacross an integral disc adapted to contact the upper edge of the neck of the bottle or flask, said disc having therein a downwardly depending flange defining a dispensing opening adapted to align and cooperate with an opening in the neck of the bottle or flask to dispense product therefrom; and a stopper member having a closed upper end and an open lower end, said stopper member having means cooperating with said intermediate member for removably attaching said stopper member to said intermediate member such that said closed upper end of said stopper member blocks said dispensing opening of said intermediate member.

* * * * *